United States Patent [19]

Goins

[11] Patent Number: 4,553,849

[45] Date of Patent: Nov. 19, 1985

[54] METHOD FOR BLENDING SOLIDS OR THE LIKE

[75] Inventor: Robert R. Goins, Bartlesville, Okla.

[73] Assignee: Phillips Petroleum Company, Bartlesville, Okla.

[21] Appl. No.: 651,148

[22] Filed: Sep. 17, 1984

Related U.S. Application Data

[62] Division of Ser. No. 526,845, Aug. 26, 1983, Pat. No. 4,518,260.

[51] Int. Cl.[4] ..... B01F 5/24; B01F 15/02

[52] U.S. Cl. ..... 366/134; 366/137; 366/177; 366/341

[58] Field of Search ..... 366/131, 134, 136, 137, 366/159, 178, 191, 177, 336, 338, 340, 184, 341, 140, 101-107; 222/459, 564; 406/146

[56] References Cited

U.S. PATENT DOCUMENTS

| | | | |
|---|---|---|---|
| 3,216,629 | 11/1965 | Goins | 366/159 X |
| 3,275,303 | 9/1966 | Goins | 366/137 |
| 3,539,154 | 11/1970 | Goins | 366/134 |
| 4,068,828 | 1/1978 | Goins | 366/136 |

*Primary Examiner*—Timothy F. Simone
*Attorney, Agent, or Firm*—French and Doescher

[57] ABSTRACT

Particulate materials are blended in a vessel provided with a plurality of vertically extending conduits therein. The vessel comprises a downwardly converging frustoconically shaped bottom wall which defines the lower region of the vessel. The conduits are provided with a plurality of longitudinally extending compartments having openings within the upper region of the vessel. The lower ends of the conduits and the compartments therein extend through the bottom wall, each communicating via a corresponding connecting conduit with a solids outlet at the open bottom of the bottom wall. At least one drain conduit communicates between a corresponding opening in the bottom wall and a corresponding compartment at a location below the bottom wall. A baffle is disposed within the vessel separating the upper and lower regions and comprises a downwardly converging inverted generally conical portion spaced above the bottom wall and defining therebetween a downwardly converging annular passage. Extensions of the compartments are contained within the connecting conduits. Various arrangements of positioning and spacing of drain conduits and corresponding openings in the bottom wall are disclosed to improve flow, sampling and blending of particulate materials from the lower region of the vessel. Methods of blending solids using the described apparatus are also disclosed.

6 Claims, 8 Drawing Figures

METHOD FOR BLENDING SOLIDS OR THE LIKE

This is a division of application Ser. No. 526,845, filed Aug. 26, 1983, now U.S. Pat. No. 4,518,260.

The invention relates generally to improvements in blending particulate materials or solids, and more particularly, but not by way of limitation, to improved method and apparatus for such blending of particulate materials.

It is often necessary to blend or homogenize hopper car- or truck-size batches of particulate materials or solids in order to produce uniform mixtures. In the plastics industry, for example, slight variations in properties of polymers may occur in different production runs. Blending of the pellets made in such runs is important to insure products of uniform quality. As disclosed In U.S. Pat. Nos. 3,216,629, 3,275,303, 3,456,922 and 4,068,828, efficient blending of particulate materials can be accomplished by the use of apparatus which comprises a vessel having a plurality of vertically extending conduits therein. The solids to be blended are positioned within the vessel surrounding the conduits. The conduits are provided with openings through which the particles enter the conduits to flow by gravity downwardly through the conduits to a common collection zone.

While blending apparatus of the general type disclosed in the foregoing patents has been found to be quite effective, it has been found to be desirable to obtain improved sampling and blending of particulate materials or solids from the lower region of such blending apparatus.

In accordance with the present invention, improved blenders of the general type described above are provided. The blenders of the present invention employ a blender vessel having an upper region and a lower region. The lower region of the blender vessel is defined by a downwardly converging, preferably frustoconically shaped, bottom wall terminating in a solids outlet at its lowermost portion. A plurality of conduits each positioned within the vessel extead in a generally vertical direction downwardly from the upper region through the lower region and through the bottom wall. At least one of the conduits contains a longitudinally extending divider for dividing the conduit into a plurality of longitudinally extending compartments. At least a portion of the compartments have at least one first opening therein in the upper region of the vessel to permit solids in the upper region to enter the conduit and flow by gravity through such compartments. Each of the compartments of at least one of the conduits extends downwardly from the upper region of the vessel through the lower region and through and below the bottom wall.

A connecting conduit communicates between the lower end of each corresponding conduit and the solids outlet and contains at least one generally longitudinally extending connecting divider connected at its upper end to the lower end of a corresponding longitudinally extending divider to divide the connecting conduit into a plurality of extensions of said compartments communicating with and extending from the lower ends of the corresponding compartments at least a substantial distance toward the solids outlet to permit solids flowing downwardly through the compartments to continue to flow by gravity downwardly through the extensions of said compartments and the connecting conduit into the solids outlet. A first drain conduit communicates between a corresponding one of the compartments and a corresponding first opening in said bottom wall intermediate the upper region and the solids outlet for conveying solids by gravity therethrough from a location in the lower region to the corresponding first one of the compartments. At least one drain conduit communicates between a compartment extension, which is in communication with a sampling point in the upper region of the vessel via a corresponding compartment, and a corresponding opening in the bottom wall, the drain conduit being adapted to convey solids by gravity therethrough from a location in the lower region of the vessel to the compartment extension.

It is an object of the present invention to provide improved blender apparatus for blending particulate materials or solids.

It is another object of the invention to provide an improved method of blending particular materials or solids.

It is yet another object of the present invention to provide method and apparatus for improving the blending and flow of particulate materials or solids from the lower region of a blender vessel.

It is still another object of the present invention to provide improved method and apparatus for blending particulate materials or solids which method and apparatus are reliable and economical in operation.

Other aspects, advantages, and objects of the present invention will become readily apparent to those skilled in the art upon further study of the instant specification, claims and drawings in which:

Figure 1:
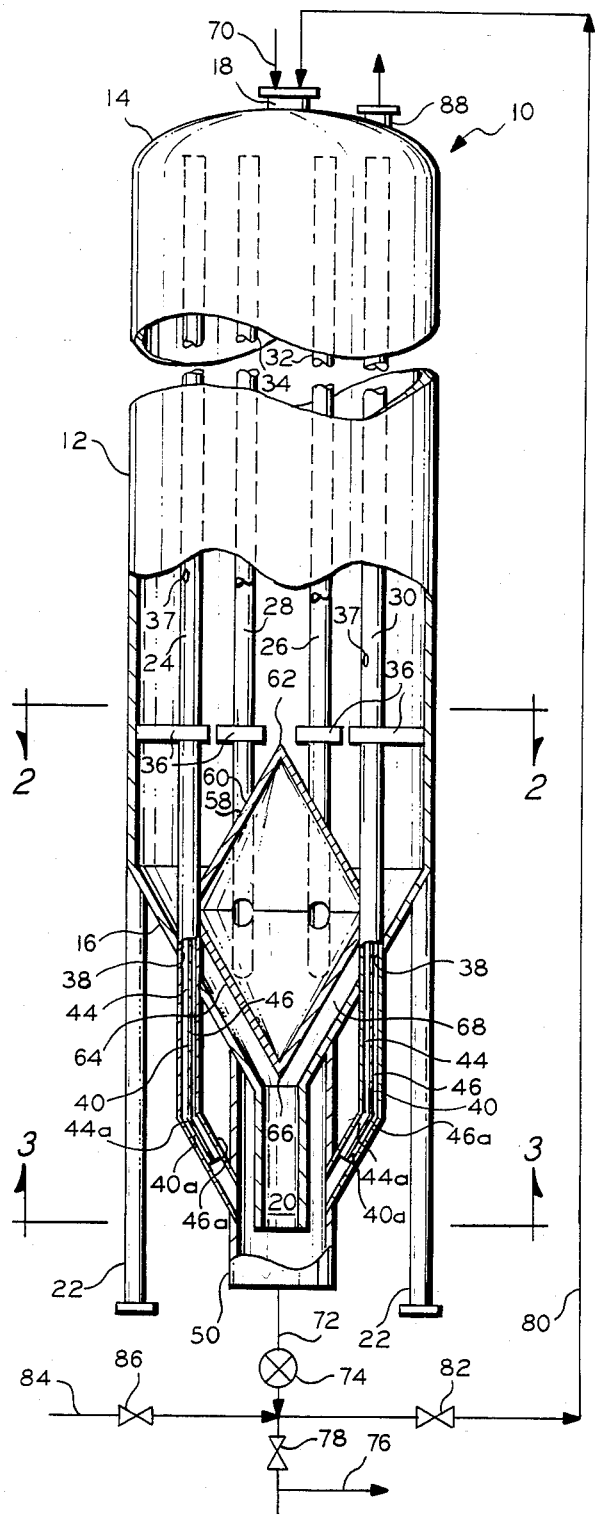
FIG. 1 is a side elevation view of one embodiment of the present invention with portions thereof broken away to illustrate the lower portion of the blender in vertical cross section.
Figure 2:
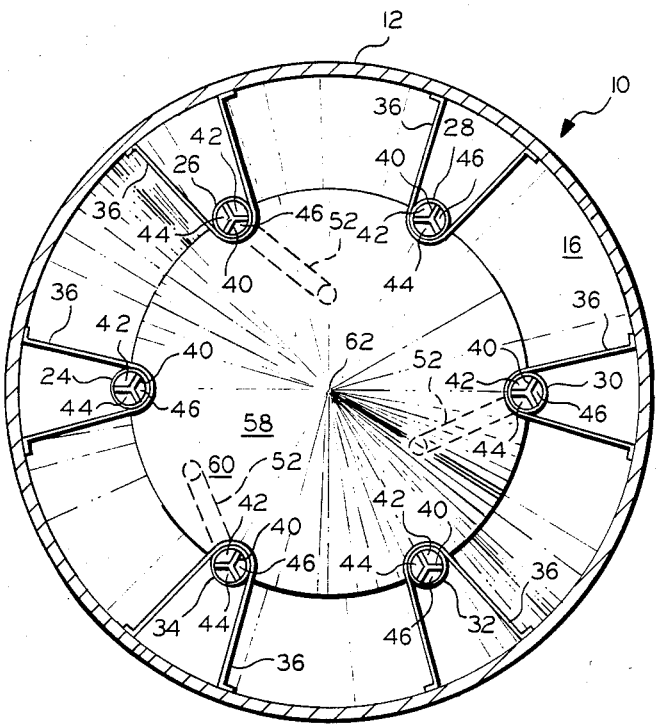
FIG. 2 is a horizontal cross section view taken along line 2—2 of FIG. 1.

Referring now to the drawings, and to FIGS. 1 and 2 in particular, there is illustrated therein an upright, generally cylindrical vessel 10 comprising a generaliy cylindrical sidewall 12, a top closure 14, and a downwardly converging, generally frustoconically shaped bottom wall or closure 16. The top closure 14 is provided with a solids inlet or filing port 18, and the bottom wall or closure 16 is provided with a solids outlet or withdrawal pipe 20 which communicates with the convergent lower end portion of the bottom wall 16. The vessel 10 can be suitably supported in a vertical position by means of a plurality of legs 22. The sidewall 12 and top closure 14 define and enclose the upper region of the vessel 10, while the bottom wall 16 defines and encloses the lower region of the vessel 10.

A plurality of conduits 24, 26, 28, 30, 32 and 34 are positioned in the upper region of the vessel 10 by means of suitable supports 36 so that the conduits are secured in generally vertical mutually parallel relation within the vessel. The upper end portion of each of the conduits is provided with at least one opening 37 therein providing communication between the interior of the conduit and the upper region of the vessel 10. The lower end portion of each of the conduits extends downwardly through the lower region of the vessel 10 and through the corresponding opening 38 in the bottom wall 16, which opening 38 is suitably sealingly engaged with the outer surface of the respective conduit extending therethrough. Each of the conduits 24, 26, 28, 30, 32 and 34 contains a longitudinally extending divider 40 extending at least substantially the full length of the conduit and dividing the conduit into a plurality, preferably three, longitudinally extending compartments 42, 44, and 46.

Figure 3:
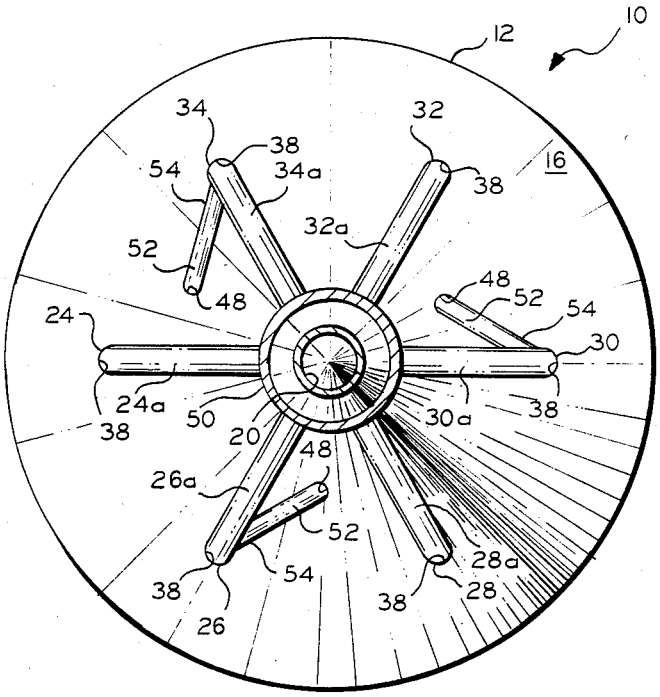
FIG. 3 is a horizontal cross section view taken along line 3—3 of FIG. 1.
Figure 6:
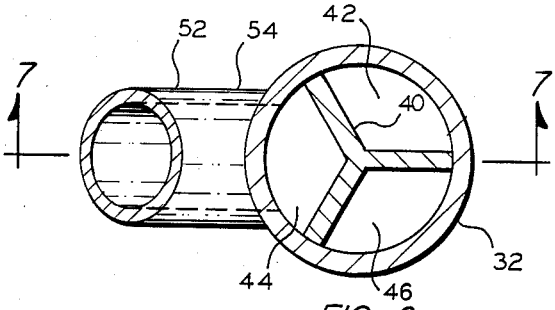
FIG. 6 is an enlarged partial horizontal cross section view taken along line 6—6 of FIG. 5 showing interior construction details.
Figure 7:
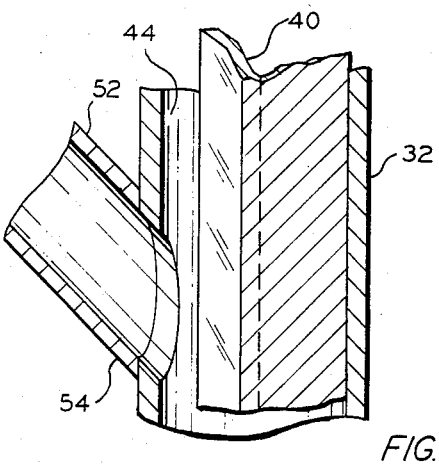
FIG. 7 is an enlarged vertical cross section view taken along line 7—7 of FIG. 6 illustrating a form of interconnection between conduits.

As shown in FIG. 3, at least one, and preferably a plurality of openings 48 are located in the bottom wall 16 of the vessel 10 intermediate the upper region of the vessel and the solids outlet 20. In the embodiment shown in FIG. 3, the openings 48 are employed with each opening 48 being preferably a different radial distance from an outlet conduit 50 which surrounds and is concentrical aligned with the solids outlet 20. The openings 48 are preferably located below and radially inwardly of the openings 38 in the bottom wall 16. Each opening 48 provides flow communication between the interior of the lower region of the vessel 10 and the upper end portion of a corresponding drain conduit 52. The lower end portion 54 of each drain conduit 52 is in flow communication with a corresponding one of the compartment extensions within the lower end portion of one of the conduits, as shown in FIGS. 6 and 7.

Inclined connecting conduits 24*a*, 26*a*, 28*a*, 30*a*, 32*a*, and 34*a* communicate respectively between the lower ends of conduits 24, 26, 28, 30, 32 and 34 and the annular space between the interior of the outlet conduit 50 and the exterior of the solids outlet 20. In a preferred embodiment, each inclined connecting conduit contains a connecting divider 40*a* connected at the upper end thereof to the lower end of the corresponding divider 40 to divide the corresponding inclined conduit into a plurality of compartment extensions 42*a*, 44*a* and 46*a* within the inclined conduit. It will be understood that, if desired, the lower end portion 54 of a drain conduit 52 can be placed in flow communication with one of compartment extensions 42*a*, 44*a* or 46*a* rather than one of the compartment extensions 42, 44 or 46 in the lower end portion of one of the conduits 24, 26, 28, 30, 32, 34 and 36. It is presently preferred that each drain conduit 52 be inclined at an angle of no more than about 45° from the horizontal at its connection with a corresponding compartment extension. An angle of inclination of about 45° from the horizontal has been shown to be suitable to prevent solids contained in such a drain conduit from forcing their way into a corresponding compartment extension which is filled with solids flowing therethrough, while permitting free flow of solids through the drain conduit into a compartment which is void of other solids.

Each drain conduit 52 provides means for conveying particulate materials or solids by gravity therethrough from a location in the lower region of the vessel 10 via a corresponding opening 48 to a corresponding first one of the compartment extensions. As noted above, each opening 48 is preferably spaced a distance downwardly along the bottom wall 16 from the sidewall 18 or upper region of the vessel 10 which is different from the distance by which at least one of the other openings 48 is spaced downwardly along the bottom wall 16 from the sidewall 12 or upper region of the vessel 10, as shown in FIG. 3., although it is within the scope of the invention for two or more of the openings 48 to be spaced the same distance downwardly along the bottom wall 16 from the sidwall 12 or upper region of the vessel 10.

Figure 8:
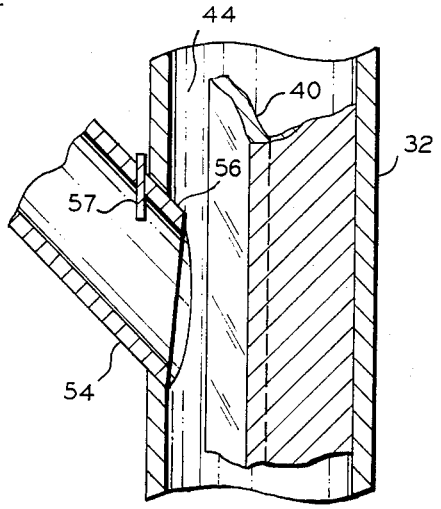
FIG. 8 is an enlarged vertical cross section view similar to FIG. 7 illustrating another form of interconnection between conduits and showing two forms of flow baffles which can be employed in the present invention to adjust flow of solids.

It may, under certain circumstances, be desirable to include a baffle 56 positioned within a corresponding compartment extension adjacent and upstream of the point of communication between the corresponding compartment extension and the corresponding drain conduit 52, as shown in FIG. 8, to provide a region of reduced cross sectional area in the compartment extension upstream of the point of communication with the corresponding drain conduit 52. This region of reduced cross sectional area is less than the cross sectional area in the compartment extension at and downstream of the point of communication between the compartment extension and the corresponding drain conduit 52. The use of a baffle 56 will permit the continuous introduction of a stream of particulate materials or solids from the corresponding drain conduit 52 into the corresponding compartment extension as the particulate materials or solids are passing downwardly through the vessel 10 and through the compartment extension. As an alternative to the baffle 56, a baffle 57 can be positioned within the lower end portion of a drain conduit 52 to restrict the flow of solids therethrough into a corresponding compartment extension.

Figure 4:
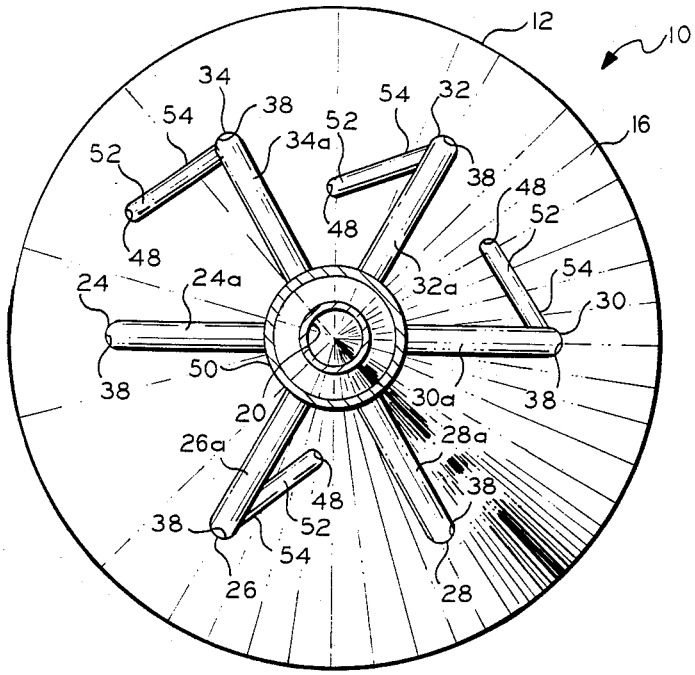
FIG. 4 is a horizontal cross section view similar to FIG. 3 illustrating another embodiment of the present invention.
Figure 5:
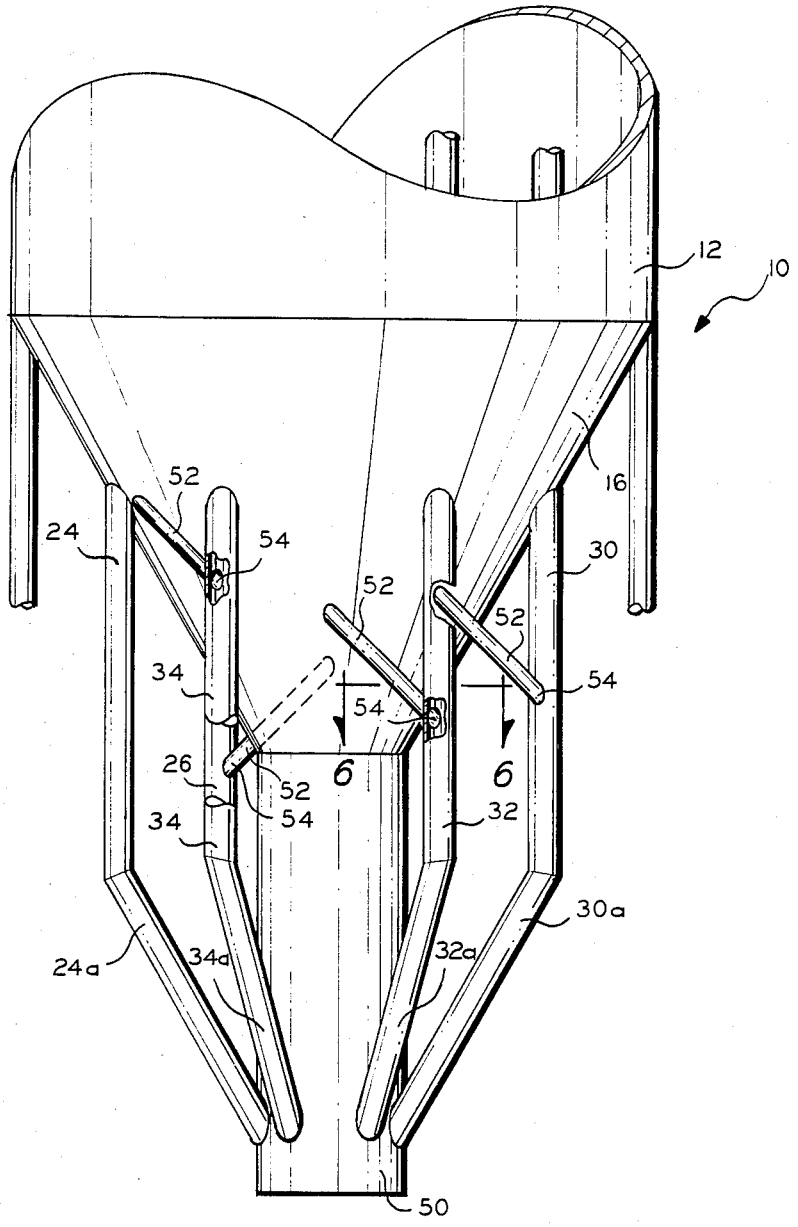
FIG. 5 is an enlarged partial side elevation view of the embodiment of the present invention illustrated in FIG. 4, with portions broken away to more clearly illustrate construction details.

The embodiment of FIG. 3 illustrates a vessel 10 which is provided with three openings 48 and three corresponding drain conduits 52 which communicate with corresponding compartment extensions contained in alternate conduits 26, 30 and 34. FIGS. 4 and 5 illustrate another embodiment wherein four drain conduits 52 communicate between four corresponding openings 48 and four corresponding compartment extensions contained in conduits 26, 30, 32 and 34, thereby providing means for conveying particulate materials or solids therethrough from a location in the lower region in the vessel 10 to the corresponding compartment extensions.

Referring again to FIGS. 1 and 2, a baffle 58 is disposed within the vessel 10 between the upper region and the lower region and blocks a substantial amount of communication between the upper and the lower regions. The baffle 58 comprises a first generally conically shaped portion 60 with the apex 62 thereof pointed upwardly, and an inverted second generally conically shaped portion 64 with the apex 66 thereof pointed downwardly. The second generally conically shaped portion 64 will be understood to include within its definition an inverted frustoconically shaped portion with the apparent apex thereof pointed downwardly. The second generally conically shaped portion 64 is positioned beneath and fixedly secured to the first generally conically shaped portion 60 and is spaced from the bottom wall 16 of the vessel 10 to form a downwardly converging annular passage 68 therebetween, which passage communicates between the upper region and the solids outlet 20 of the vessel 10. It is presently preferred that the apical angles of the first and second conically shaped portions 60 and 64, as well as the apical angle of the frustonically shaped bottom wall 16, are all approximately 60°, although smaller or larger apical angles in the range from about 40° to about 80° can be used depending upon the flow characteristics of the particulate materials being blended.

The configuration of the baffle 58 and its position relative to the upper region and the bottom wall 16 of the vessel 10 are advantageous in that they serve to decrease the inventory of particulate materials or solids below the baffle 58 in the annular passage 68 where the only exits are provided by the solids outlet 20 and the additional openings 48 in the bottom wall 16. The baffle 58 provides the additional advantage of preventing or substantially reducing the occurrence of tunneling or "rat-holing" of poorly flowing particulate materials and the occurrence of arching of particulate materials over the solids outlet 20 by decreasing the head of particulate materials or solids on the outlet. It will be understood, however, that the baffle 58 may be omitted if desired.

As illustrated in FIG. 1, the vessel 10 can be filled with particulate materials or solids to be blended by means of a conduit 70 which communicates with the solids inlet 18. A conduit 72, having control means such as a rotary star valve 74 interposed therein, is connected to outlet conduit 50 to withdraw blended particulate materials or solids. Conduit 72 is connected to a withdrawal conduit 76 in which a valve 78 is interposed. In some operations it may be desirable to recycle blended particulate materials or solids from the conduit 72 back to the upper region of the vessel 10. This can be accomplished by means of a conduit 80, having a valve 82 interposed therein, which extends from conduit 72 to the solids inlet 18. A conduit 84, having a valve 86 interposed therein, extends from a source of pneumatic pressure, not shown, to the inlet of conduit 80. The blended particulate materials or solids can thus be elevated and reintroduced into the vessel 10 via conduit 80 by means of pressurized air from the source of pneumatic pressure. The top closure 14 can be provided with a vent 88 to permit the transport air entering from the conduit 80 to be exhausted from the vessel 10.

In a first method of operation in accordance with this invention, the rotation of valve 74 is stopped to block flow through the valve 74 aad the vessel 10 is filled with particulate materials or solids to be blended via the conduit 70. The valve 74 is then rotated to allow flow therethrough and the valve 78 is opened to permit the particulate materials or solids to drain by gravity from the vessel 10 to the withdrawal conduit 76. Valve 86 is closed at this time so that no particulate materials or solids are recycled. In another embodiment of this invention, the vessel 10 can be operated in the same manner except that blending is accomplished continuously with particulate materials or solids to be blended being introduced through the solids inlet 18 and withdrawn through conduit 72 at the same time. In still another method of operation, a part or all of the blended particulate materials or solids can be recycled through conduit 80 back to the solids inlet 18 for further blending. Even in the single pass batch blending procedure first described above, it may be desirable to recycle a part of the blend of particulate materials or solids initially withdrawn from the outlet conduit 46.

The construction of the conduits 24, 26, 28, 30, 32 and 34 can be any suitable construction which will achieve desired blending of particulate materials or solids in the vessel 10. Suitable conduit construction is disclosed in U.S. Pat. No. 4,068,828 issued to the inventor of the instant invention and assigned to Phillips Petroleum Company, and the conduit construction disclosed in this patent is incorporated by reference herein. It should be noted that the baffle means disclosed in U.S. Pat. No. 4,068,828 to reduce the flow of particulate materials past the openings in the conduits are optional in the apparatus of the present invention.

It should be noted that a significant feature of the apparatus of the present invention is that there will be no flow or only a controlled small amount of flow of solids from a cone bottom opening 48 as long as there are solids flowing downwardly from the interior of the upper region of the vessel 10 via an opening 37 through the compartment to which it is connected by a drain conduit 52. This arrangement assures that flow through the various openings 48 is controlled by the drain rates and area ratios of the compartments, the openings 48, the solids outlet 20 and the outlet conduit 50. As the vessel 10 is emptied, the flow of solids automatically switches from openings 37 located in the interior of the upper region of the vessel 10 to openings 48 in the bottom wall 16 to maintain uniformity of the resulting solids blend as the solids level within the vessel 10 is lowered thus sequentially uncovering the openings 37 in the conduits 24, 26, 28, 30, 32 and 34.

From the foregoing detailed description, it will be seen that the apparatus and method of its use described and illustrated herein eminently achieve the objects of the present invention. Changes may be made in the combination and arrangement of parts or elements as heretofore set forth in the speciiication and shown in the drawings without departing from the spirit and scope of the invention as defined in and limited only by the following claims.

I claim:

1. A method of blending solids in solids blending apparatus of the type which includes:

a vessel having a solids inlet in an upper region thereof and solids outlet means in a lower region thereof, the lower region being defined by a downwardly converging generally frustoconically shaped bottom wall;

a plurality of conduits each having upper and lower ends and positioned within said vessel so as to extend in a generally vertical direction downwardly from said upper region of said vessel through said lower region of said vessel and through said bottom wall to said lower end, at least one of said conduits containing at least one longitudinally extending divider means having upper and lower ends for dividing said conduit into a plurality of longitudinally extending compartments, at least a portion of said compartments having at least one opening therein in said upper region of said vessel to permit solids in said upper region of said vessel to enter the conduit and flow by gravity downwardly through said compartments, and each of said compartments, and each of said compartments of at least one of said conduits extending downwardly from said upper region of said vessel through said lower region of said vessel and through and below said bottom wall;

connecting conduit means communicating between the lower end of each of said conduits and said solids outlet means for conveying solids by gravity therethrough from each of said conduits to said solids outlet means, at least one of said connecting conduit means containing connecting divider means having upper and lower ends and connected at the upper end thereof to the lower end of a corresponding longitudinally extending divider means for dividing said connecting conduit means into a plurality of extensions of said compartments communicating with and extending from the lower ends of the corresponding compartments at least a substantial distance toward said solids outlet means to permit solids flowing downwardly through said compartments to continue to flow by gravity downwardly through said extensions of said compartments and said first connecting conduit means into said solids outlet means; and first drain conduit means communicating between a corresponding first one of said compartments and a corresponding first opening in said bottom wall intermediate said upper region and said solids outlet means for conveying solids by gravity therethrough from a location in said lower region to said corresponding first one of said compartments, which method comprises:

introducing solids to be blended into said vessel through said solids inlet, conveying solids by gravity through said first drain conduit from a location in the lower region to the corresponding first one of the compartments and withdrawing blended solids through said solids outlet means.

2. A method of blending solids in accordance with claim 1 wherein solids are not withdrawn from said solids outlet means until all of the solids to be blended at a given time are disposed in said vessel.

3. A method of blending solids in accordance with claim 1 wherein solids are withdrawn from said solids outlet means during the time that solids are introduced through said solids inlet.

4. A method of blending solids in accordance with claim 1 wherein a portion of the solids withdrawn from said solids outlet means are returned to an upper portion of said upper region of said vessel.

5. A method of blending solids in solids blending apparatus of the type which includes:

a vessel having a solids inlet in an upper region thereof and solids outlet means in a lower region thereof, the lower region being defined by a downwardly converging generally frustoconically shaped bottom wall;

six conduits each having upper and lower ends and positioned within said vessel so as to extend in a generally vertical direction downwardly from said upper region of said vessel through said lower region of said vessel and through said bottom wall to said lower end, each of said conduits containing longitudinally extending divider means having upper and lower ends for dividing said conduit into a three longitudinally extending compartments, at least a portion of said compartments having at least one first opening therein in said upper region of said vessel to permit solids in said upper region of said vessel to enter the conduit and flow by gravity downwardly through said compartments, and each of said compartments of each of said conduits extending downwardly from said upper region of said vessel through said lower region of said vessel and through and below said bottom wall;

six connecting conduit means each communicating between the lower end of a corresponding one of said conduits and said solids outlet means for conveying solids by gravity therethrough from each of said conduits to said solids outlet means, each of said connecting conduit means containing connecting divider means having upper and lower ends and connected at the upper end thereof to the lower end of a corresponding longitudinally extending divider means for dividing said connecting conduit means into three extensions of said three compartments communicating with and extending from the lower ends of the corresponding three compartments at least a substantial distance toward said solids outlet means to permit solids flowing downwardly through said compartments to continue to flow by gravity downwardly through said extensions of said compartments and said first connecting conduit means into said solids outlet means;

first drain conduit means communicating between a corresponding first one of said compartments and a corresponding first opening in said bottom wall intermediate said upper region of said vessel and said solids outlet means for conveying solids by gravity therethrough from a location in said lower region of said vessel to said corresponding first one of said compartments;

second drain conduit means communicating between a corresponding second one of said compartments and a corresponding second opening in said bottom wall intermediate said upper region of said vessel and said solids outlet means for conveying solids by gravity therethrough from a location in said lower region of said vessel to said second one of said compartments; and third drain conduit means communicating between a corresponding third one of said compartments and a corresponding third opening in said bottom wall intermediate said upper region of said vessel and said solids outlet means for conveying solids by gravity therethrough from a location in said lower region of said vessel to said third one of said compartments, which method comprises:

introducing solids to be blended into said vessel through said solids inlet, conveying solids by gravity through said first drain, second drain and third drain conduits from locations in the lower region to the corresponding first, second, and third one respectively, of the compartments and withdrawing blended solids through said solids outlet means.

6. A method of blending solids in said blending apparatus of the type which includes:

a vessel having a solids inlet in an upper region thereof and solids outlet means in a lower region thereof, the lower region being defined by a downwardly converging generally frustoconically shaped bottom wall;

six conduits each having upper and lower ends and positioned within said vessel so as to extend in a generally vertical direction downwardly from said upper region of said vessel through said lower region of said vessel and through said bottom wall to said lower end, each of said conduits containing longitudinally extending divider means having upper and lower ends for dividing said conduit into a three longitudinally extending compartments, at least a portion of said compartments having at least one first opening therein said upper region of said vessel to permit solids in said upper region of said vessel to enter the conduit and flow by gravity downwardly through said compartments, and each of said compartments of each of said conduits extending downwardly from said upper region of said vessel through said lower region of said vessel and through and below said bottom wall; vessel and said solids outlet means for conveying solids by gravity therethrough from a location in said lower region of said vessel to said fourth one of said compartments, which method comprises:

introducing solids to be blended into said vessel, conveying solids by gravity through said first, second, third and fourth drain conduits from locations in the lower region to the corresponding first, second, third, and fourth one, respectively, of the compartments and withdrawing blended solids through said solids outlet means.

* * * * *